US007178278B1

(12) United States Patent
Morris

(10) Patent No.: US 7,178,278 B1
(45) Date of Patent: Feb. 20, 2007

(54) METHOD FOR INTERCHANGEABLY PROMOTING A BUSINESS ON A HAT

(75) Inventor: Russell Earl Morris, 650 Crescent Blvd., Southwest, Calgary (CA) T2S 1L2

(73) Assignee: Russell Earl Morris (CA)

( * ) Notice: Subject to any disclaimer, the term of this patent is extended or adjusted under 35 U.S.C. 154(b) by 458 days.

(21) Appl. No.: 10/757,005

(22) Filed: Jan. 14, 2004

Related U.S. Application Data

(60) Provisional application No. 60/440,139, filed on Jan. 15, 2003.

(51) Int. Cl.
*G09F 21/02* (2006.01)

(52) U.S. Cl. ..... 40/329; 24/3.12; 2/209.12; 2/209.13

(58) Field of Classification Search ..... 40/329, 40/313; 2/209.13, 209.12; 24/3.12
See application file for complete search history.

(56) References Cited

U.S. PATENT DOCUMENTS

| | | | | | |
|---|---|---|---|---|---|
| 891,434 | A * | 6/1908 | Olander | 217/61 |
| 991,102 | A * | 5/1911 | Speice | 40/313 |
| 1,228,341 | A | 5/1917 | Maynard | 2/10 |
| 1,514,111 | A | 11/1924 | Sutton | 2/10 |
| 2,519,959 | A | 8/1950 | Fisher | 2/10 |
| 2,560,669 | A | 7/1951 | Vaca | 2/10 |
| 2,691,164 | A | 10/1954 | Feldman | 2/10 |
| 4,304,005 | A | 12/1981 | Danley | 2/10 |
| 4,541,125 | A | 9/1985 | Phillips | 2/10 |
| 4,819,274 | A | 4/1989 | Day | 2/10 |
| 4,985,935 | A * | 1/1991 | Hur | 446/27 |
| 5,129,102 | A | 7/1992 | Solo | 2/10 |
| 5,208,916 | A | 5/1993 | Kelman | 2/10 |
| 5,271,099 | A * | 12/1993 | Lin | 2/10 |
| 5,279,985 | A * | 1/1994 | Kamiyama | 438/396 |
| 5,412,812 | A | 5/1995 | Gatchalian | 2/10 |
| 5,422,686 | A | 6/1995 | Kelman | 351/155 |
| 6,694,526 | B1 * | 2/2004 | Tate | 2/209.12 |
| 7,051,406 | B1 * | 5/2006 | Morris et al. | 24/3.12 |

* cited by examiner

*Primary Examiner*—Cassandra Davis
(74) *Attorney, Agent, or Firm*—Buskop Law Group PC; Wendy K. Buskop

(57) ABSTRACT

The method entails disposing advertising on a cover of an apparatus for hands-free holding of an article to a hat that has a substantially stiff lower clamp with a shape contoured to match a hat and two planar surfaces to provide grip support integral with the first planar surface, a substantially stiff upper clamp with engaging two arms integrally secured to the first planar surface, wherein the inner arm slides inside the crown alongside the head of the user, the other side inside of the crown, and wherein the outer arm that is substantially parallel to the inner arm and spaced enough from the inner arm to attach removably to the crown; a spring fixedly secured to the base of the outer arm and extending away from the base substantially parallel to and to secure removably an article; and a soft outer clamp secured to the spring for additionally holding the article.

15 Claims, 4 Drawing Sheets

METHOD FOR INTERCHANGEABLY PROMOTING A BUSINESS ON A HAT

The present application claims priority to Provisional U.S. Patent Application Ser. No. 60/440,139 filed Jan. 15, 2003.

FIELD

Embodiments relate to methods for promoting a business on a hat.

BACKGROUND

Pins for hats are known. Clips to hold eyeglasses are known.

U.S. Pat. No. 5,422,686 discloses an eyeglass assembly for visored headgear that includes an adjustable clip for attaching the eyeglasses to the visor. The distance between the clips is adjustable, enabling the user to vary the distance between the eyeglasses and the user's eyes. The attachment of the eyeglasses to the visor is relatively insecure. Also, the lens is fixed to posts on a hinge and is therefore not easily replaced. However, this holder is not used to promote a business.

U.S. Pat. No. 5,129,102 describes a base having a pair of C-shaped clips attached to VELCRO™ tape to the underside of the bill of a cap. A pair of ordinary sunglasses has cylindrical members that snap into the C-shaped clips to support rotatably the sunglasses. A need exists to use a clip holder as an advertising device.

U.S. Pat. No. 4,541,125 describes a holder with a relatively long band having a pair of flat hooks that clip onto the bill of a cap. The center of the band has a bar that supports a C-shaped clip providing a hinge for a set of rotatable eyeglasses. The band is not used for advertising or imprinting in a removable way to advertise a business.

Thus, a need exists for a method for advertising on apparatus for hands-free holding of an article, such as a pencil, or other device that can be easily attached to and be retained on a baseball style cap, having a bill. A need has existed for a device to have an interchangeable feature so that various logos and businesses can be advertised on the device.

SUMMARY

The method for advertising a business entails disposing advertising on a cover of an apparatus for hands-free holding of an article to a hat. The apparatus has a substantially stiff lower clamp for attaching to a hat that has a bill and a crown that covers the head of a user. The apparatus also has a substantially stiff upper clamp for gripping an article such as eyeglasses, sunglasses or other devices. In the preferred embodiment, the substantially stiff lower clamp has a shape contoured to match the juncture of the bill with the crown and a first lower planar surface with serrated teeth designed to grip the underside of the cap bill. The apparatus also has an upper planar surface to provide grip support integral with the first planar surface. Preferably, the upper planar surface is oriented approximately parallel to the first planar surface and, combined with the upper planar surface and the lower planar surface, are situated to grip the bill of the cap firmly. The substantially stiff lower clamp is adapted to removably attach to the bill.

The substantially stiff upper clamp is designed to be secured integrally to the first planar surface and has a base engaging two arms. The inner arm slides inside the cap. The inner arm has a head side that rests along side the head and a hat side that rests along side the inner part of the cap. The outer arm is substantially parallel to the inner arm support in a spaced apart relationship from the inside support to removably attach to the crown at the hatband portion of the cap.

The outer arm has a soft outer cover and a smaller middle arm acting as a spring for fixedly attaching sunglasses or the like. The spring is fixedly secured to the outer arm and extends away from the arm substantially parallel to and in a spaced relationship from external side to removably secure an article.

BRIEF DESCRIPTION OF THE DRAWINGS

The present method will be explained in greater detail with reference to the appended figures, in which.

The present method is detailed below with reference to the listed Figures.

DETAILED DESCRIPTION OF THE PREFERRED EMBODIMENTS

Before explaining the present method in detail, it is to be understood that the method is not limited to the particular embodiments and that it can be practiced or carried out in various ways.

Figure 1:
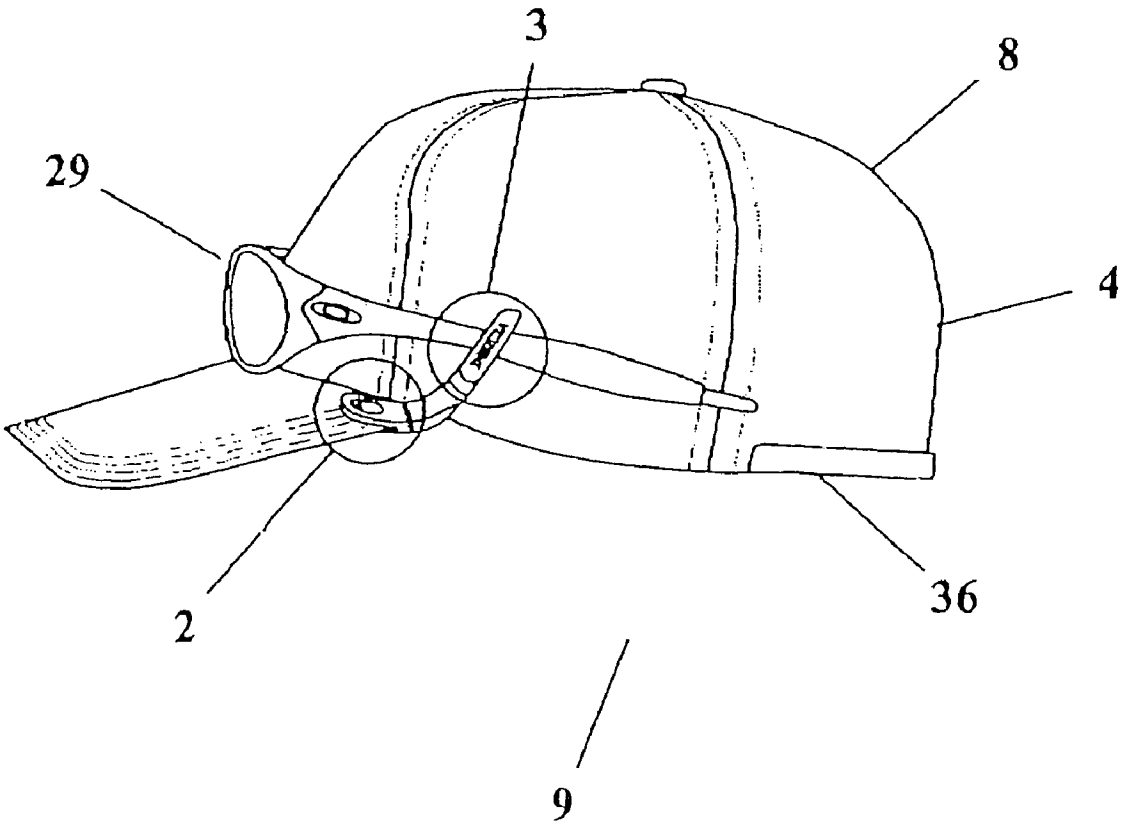
FIG. 1 depicts a perspective view of the cap with bill and holding apparatus.
Figure 2:
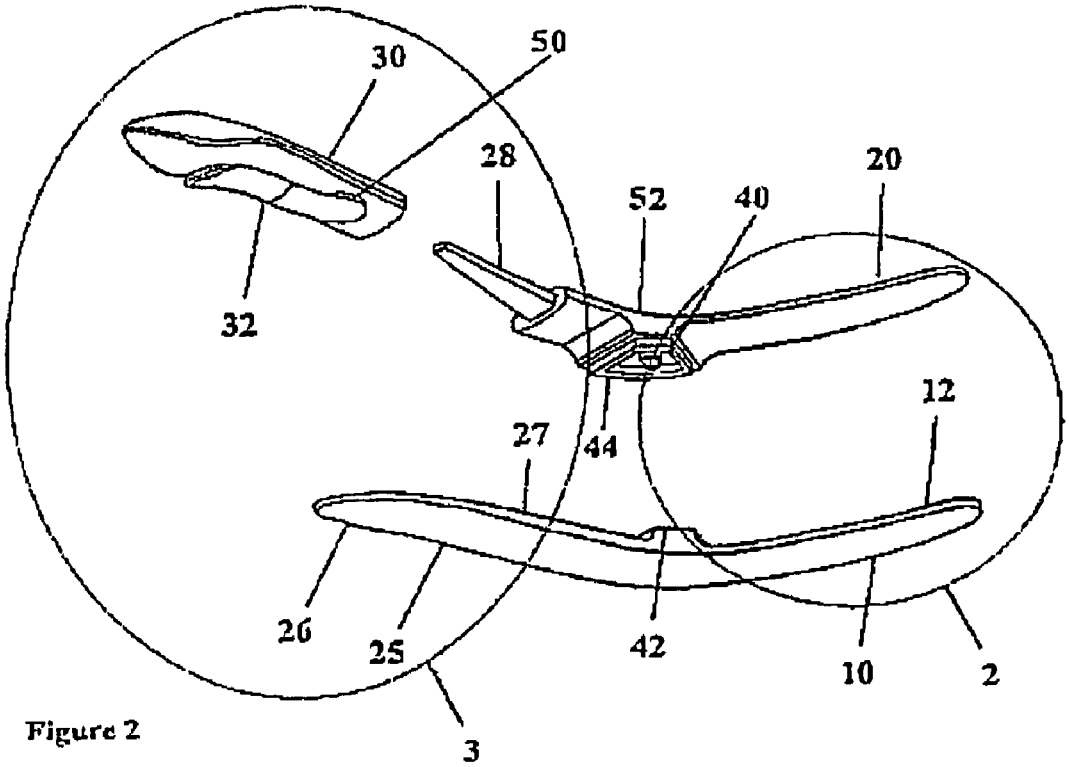
FIG. 2 depicts an exploded view of the clamp used in the apparatus.
Figure 3:
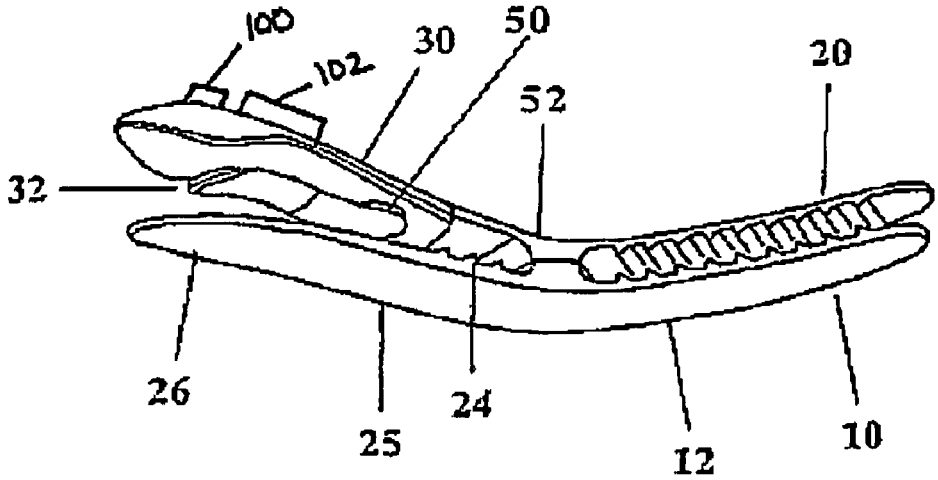
FIG. 3 depicts a rear view of the clamp used in the apparatus.
Figure 4:
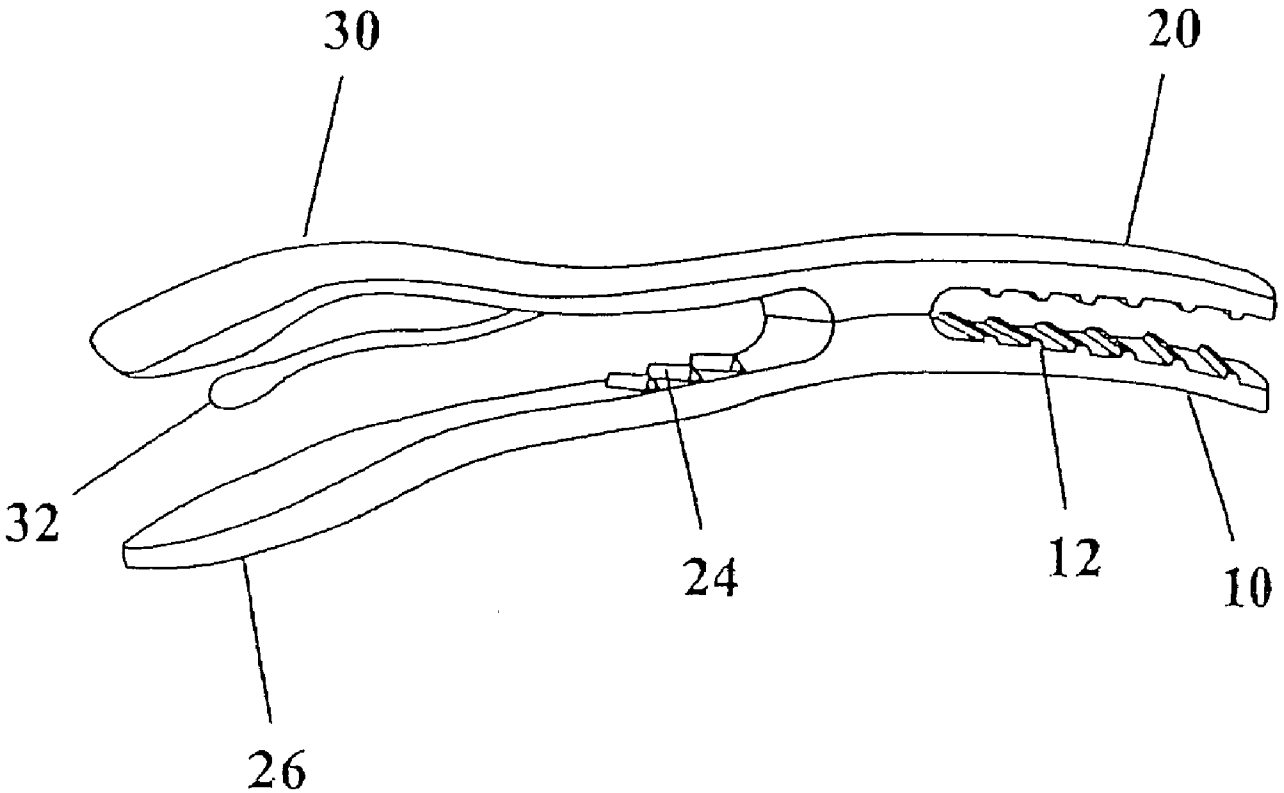
FIG. 4 depicts a front view of the clamp used in the apparatus.

In the presently preferred embodiment, the apparatus for hands-free holding of an article (29) on a hat (4) as used in the method is depicted in FIG. 1. The apparatus is shown in more detail in FIG. 2, FIG. 3, and FIG. 4.

The method entails advertising a business by disposing advertising on a cover of an apparatus for hands-free holding of an article to a hat.

The apparatus is made of a substantially stiff lower clamp assembly (2) and a substantially stiff upper clamp assembly (3). The stiff lower clamp assembly (2) has an inner arm (10) and an outer arm (20). The substantially stiff upper clamp assembly (3) has an inner arm (26) and an outer arm (28) with a soft outer cover and spring (32).

By design, the upper and lower clamp assemblies (2 and 3) provide independent functions. The lower clamp assembly (2) grips the bill of the cap. The upper clamp assembly (3) grips both the hat band and crown of the cap as well as eyeglasses, sunglasses or other devices to be held in place by the clamp. These assemblies are held together by a mechanical connector (40).

The substantially stiff lower clamp assembly (2) is used to attach to a hat (4) that has a bill (6) and a crown (8) that covers the head (9) of a user. Preferably, the substantially stiff lower clamp has a shape to match the juncture of the bill with the crown. The substantially stiff lower clamp also has a first planar surface (10) with serrated teeth or other friction gripping mechanism either partially or entirely along the surface. The outside arm support is oriented approximately parallel to the first planar surface and, combined with the support arms form the substantially stiff lower clamp, grip a hat bill and also removably attach to the bill.

The lower clamp (2) can be made from a variety of materials including metal, coated metal, rigid plastic, urethane and combinations thereof.

The substantially stiff upper clamp assembly (3) also is for gripping the crown (8) of the cap (4) in the hatband area (36) holding in place an article such as sunglasses (29). Preferably, the substantially stiff upper clamp has a shape to match the contour of the crown of the cap and is secured to the lower clamp through integral design and a mechanical connection (40).

The substantially stiff upper clamp has an inner arm (26) integrally connected to, but separated from, an upper arm (28) by enough space for a cap hat band (36) to intercede. With reference to both FIG. 1 and FIG. 2, the inner arm (26) has a head side (25) and an inner planar surface (27) and is substantially parallel to the inner supporting arm (28) in a spaced apart relationship to attach removably to the crown.

The inner planar surface (27) can have serrated teeth (24) or other friction gripping mechanism either partially or entirely along the surface. The outside support arm also has a soft cover and may or may not have a flexible spring for gripping an external article. The upper clamp assembly (3) can be made from a variety of materials including metal, coated metal, rigid plastic, polyurethane and combinations thereof. The outside support arm cover (30) can be made of soft rubber, plastic, foam, metal, coated metal or combinations thereof.

Indicia usable on the cover can be various forms of advertising such as a corporate name, a corporate logo, corporate colors, battery operated miniature lights, 100 and battery operated miniature fiber optic displays 102 that are programmable to show a corporate name, and other similar designs that indicate the source of a service or good. Another type of indicia is artistic representations, such as artwork that is distinctive to a particular artist, such a Wyland whale paintings.

The soft outer clamp (30) can also include a clear material. The spring (32) could also be imprinted with additional indicia of the type described above. The soft outer clamp (30) and the spring (32) create a "water resistant" method for promoting a business.

The soft outer clamp (30) is secured to the spring (32), which is secured to a base (50) and extending away from the base (52) for additionally holding the article (29). The soft outer clamp (30) is made of a material that allows printing of various types of indicia or to which various types of indicia may be attached for advertising or promoting business. Examples of indicia are advertising by using trademarks, identifying marks, ornamental structure, designs, patterns, artistic representations and combinations thereof. The soft outer clamp (30) can also include a clear material, wherein the inner supporting arm (28) includes similar indicia.

The spring (32) could also be imprinted with additional indicia of the type described above. The soft outer clamp (30) and the spring (32) create a "water resistant" method for promoting a business.

The spring can have the same miniature lights display or other forms of advertising, trademarks, patterns, artistic representations and combinations. Indicia could be use on both structures, such as in an overlay fashion, for use in the novel method. The miniature lights or miniature light display can be conventional fiber optic battery operated miniature lights or fiber optic battery operated miniature displays, such as those in "n" gauge train gardens, and are powered by watch size batteries.

In the most preferred embodiment, the inner planar surface (27) of the inner arms (10 and 26) of both clamp assemblies have a lower female connector (42) that engages an upper male mechanical connector (44). The upper male mechanical connector (44) is attached to the outer arms (20 and 28) of both clamp assemblies. The lower female connector (42) and the upper male connector (44) together comprise a rigid mechanical connection (40) that holds the outer and inner arms of the clamp assemblies together. The apparatus also contemplates that this connection can be a hinge to allow more flexible movement between the upper and lower clamps and between the inner and outer arms of the upper clamp. The planar surfaces of the upper and lower half of the clamp can be held together by either a rigid or flexible mechanical connection. In the rigid connection, the upper planar surface fits snugly into the lower planer surface forming an interference type fit (44 into 42). Alternatively, the upper planar surface can be secured to the lower planer surface by gluing, ultrasonic welding, or by using mechanical connections, such as screwing or riveting the surfaces together at the midpoint. In the flexible connection, the upper and lower planar surfaces can be connected in a variety of manners. The upper and lower planar surfaces can be connected by a slightly less tight fit than in the rigid connection (44 into 42). The less tight fit allows for some tolerance between the parts, thereby allowing the arms to flex around joint. The upper and lower planar surfaces can have a flexible connection based on material selection. The upper and lower planar surfaces can be made of a flexible plastic that allows for "spring-like" movement of the arms relative to the mechanical connection. Alternatively, a spring can be added between the upper and lower planar surfaces, wherein each end of the spring connects the upper and lower planar surfaces, thereby forming a flexible mechanical connection.

In the present apparatus, the upper clamp has a curvilinear shape. Most preferably, the curvilinear shape of the inner arm (26) is the shape of the contour of a head and the curvilinear shape of the outer arm (28) with the outer cover attached is the shape of the contour of the hat.

The outer arm (20) at the base (52) of the lower clamp assembly (2) can include indicia and marking such as advertising using trademarks, identifying marks, ornamental structure, designs, patterns, artistic representations and combinations thereof. Alternatively, the soft outer clamp can also include similar type of indicia. The soft outer clamp can also include the clear material and the spring for indicia.

While this method has been described with emphasis on the preferred embodiments, it should be understood that within the scope of the appended claims, the method might be practiced other than as specifically described herein.

What is claimed is:

1. A method for advertising a business comprising the steps of:

a. disposing advertising on a cover of an apparatus for hands free holding of an article to a hat, wherein the apparatus comprises:

i. a substantially stiff lower clamp for attaching to a hat comprising a bill and a crown that cover a head of a user, wherein the substantially stiff lower clamp comprises:

1. a shape contoured to match the juncture of the bill with the crown; and 2. a first lower planar surface with serrated teeth designed to grip the underside of the bill and an upper planar surface to provide grip support integral with the first planar surface, also oriented approximately parallel to the first planar surface and adapted to removably attach to the bill;

ii. a substantially stiff upper clamp integrally secured to the first planar surface, and wherein the substantially stiff upper clamp comprises a base engaging two arms, wherein an inner arm of the two engaging arms slides inside the crown on one side for resting alongside the head of the user and the other side resting against the inside of the crown, wherein the inner arm of the two engaging arms comprises a surface that has serrated teeth to hold the hat and an outer arm of the two engaging arms that is substantially parallel to the inner arm and is in a spaced apart relationship to the inner arm to removably attach to the crown;

iii. a spring fixedly secured to a spring base on the outer arm and extending away from the base substantially parallel to a soft outer clamp, wherein the spring is adapted to removably secure an article; and iv. a soft outer clamp secured to the spring for additionally holding the article;

b. wherein the advertising is selected from the group consisting of a printed corporate name, a printed corporate logo, an advertising label, a printed slogan; a printed artwork; a label comprising artwork indicating origin of a good or service, and combinations thereof.

2. The method of claim 1, wherein the lower clamp is a member selected from the group consisting of metal, coated metal, rigid plastic, urethane and combinations thereof.

3. The method of claim 1, wherein the upper clamp is a member selected from the group consisting of metal, coated metal, rigid plastic, rubber, foam, polyurethane, and combinations thereof.

4. The method of claim 1, wherein the planar surfaces of each clamp are connected together by friction gripping mechanisms.

5. The method of claim 1, wherein the stiff lower and upper clamps are adapted to attach to each side of the hat and hold an external device symmetrically.

6. The method of claim 1, wherein the upper clamp comprises a curvilinear shape.

7. The method of claim 1, wherein the lower clamp and the upper clamp are connected with a rigid mechanical connection or a flexible hinge.

8. The method of claim 1, wherein the spring is a plastic spring or a steel spring.

9. The method of claim 1, wherein the soft outer clamp further comprises a cover.

10. The method of claim 1, wherein the cover is made from a soft, foam-like material adapted to engage an external device.

11. The method of claim 1, wherein the soft outer clamp includes indicia selected from the group consisting of advertising, trademarks, identifying marks, ornamental structure, designs, patterns and artistic representations.

12. The method of claim 1, wherein the method further comprises the step of using a clear or opaque material for the cover and then printing indicia for advertising on the cover.

13. The method of claim 1, wherein the advertising, is selected from the group consisting of: trademarks, identifying marks, ornamental structure, designs, patterns and artistic representations printed on or attached to the stiff lower clamp.

14. The method of claim 1, wherein the method further comprises the step of adding battery operated miniature lights on the cover of an apparatus for hands free holding of an article to a hat.

15. The method of claim 1, wherein the method further comprises the step of adding a battery operated miniature display sign to the cover of an apparatus for hands free holding of an article to a hat.

* * * * *